US006126501A

United States Patent [19]

Hooper et al.

[11] Patent Number: 6,126,501

[45] Date of Patent: Oct. 3, 2000

[54] MOORING SYSTEM FOR TANKER VESSELS

[75] Inventors: Alan Gregory Hooper, Singapore, Singapore; Babu George, Kerala, India; David Lee Hock Choon, Singapore, Singapore

[73] Assignee: Nortrans Offshore(s) PTE LTD, Singapore

[21] Appl. No.: 09/396,724

[22] Filed: Sep. 15, 1999

[51] Int. Cl.[7] ..... B63B 22/02

[52] U.S. Cl. ..... 441/5; 114/293; 114/230.12

[58] Field of Search ..... 441/3–5; 114/293, 114/230.12

[56] References Cited

U.S. PATENT DOCUMENTS

| | | | |
|---|---|---|---|
| 3,111,926 | 11/1963 | Shatto, Jr. . | |
| 3,979,785 | 9/1976 | Flory . | |
| 4,130,076 | 12/1978 | van Bilderbeek | 441/5 |
| 4,601,252 | 7/1986 | Wuttudal . | |
| 4,637,335 | 1/1987 | Pollack . | |
| 4,637,336 | 1/1987 | Engelskirchen . | |
| 4,727,819 | 3/1988 | Pollack . | |
| 4,802,431 | 2/1989 | Pollack . | |
| 4,820,217 | 4/1989 | Joubert et al. . | |
| 4,825,797 | 5/1989 | Poldervaart et al. . | |
| 4,917,038 | 4/1990 | Poldervaart et al. . | |
| 5,025,743 | 6/1991 | Pollack . | |
| 5,205,768 | 4/1993 | Pollack . | |
| 5,545,065 | 8/1996 | Breivik et al. . | |
| 5,755,607 | 5/1998 | Boatman et al. | 441/5 |
| 5,816,183 | 10/1998 | Braud et al. . | |
| 5,941,746 | 8/1999 | Isnard et al. | 441/4 |

*Primary Examiner*—Jesus D. Sotelo
*Attorney, Agent, or Firm*—Jones, Tullar & Cooper PC

[57] ABSTRACT

A mooring system employs a vessel mounted turret in combination with a submerged chain table that also acts as a clump weight. The chain table is submerged fairly close to the sea surface at approximately the keel depth of the vessel, or a few meters below that depth. Three or more chains connect the vessel mounted turret and chain table to one another, preferably though corresponding U-joints. Several mooring lines are attached at first ends to the bottom of the chain table, and are secured at second ends to anchors or piles in the seabed. The weight of the chain table is chosen so that it helps reduce the stresses imparted by the vessel to the mooring lines, thereby reducing the maximum load requirement, and thus cost, of the mooring lines. In addition, a vessel mounted drive system is not needed for the turret mooring because the chains connecting the chain table to the turret mooring are positioned and spaced in such a manner that they apply enough force to the turret that it will remain in position relative to the chain table when the vessel rotates in response to wind or wave forces.

18 Claims, 3 Drawing Sheets

S
d
12
16
20
14
18
22
26
28
30
34
40
39
38
46
39
38
10
44
41
42
41
42

MOORING SYSTEM FOR TANKER VESSELS

BACKGROUND OF THE INVENTION

The present invention relates to a mooring system for tanker vessels that employs a vessel mounted turret in combination with a submerged chain table and a plurality of mooring lines to moor the vessel.

FPSOs are Floating Production, Storage and Offloading vessels which are employed to temporarily store oil received from offshore subsea and dry surface wells (or in the case of an FSO, pumped from offshore production facilities) until an oil tanker arrives to receive the oil from the FPSO. Typically, an FPSO is itself an oil tanker that has been modified to receive the oil directly from one or more subsea risers (flexible pipelines), and be moored in a fixed position near the offshore oil wellheads or production facilities. The mooring systems employed to hold the FPSOs in place must be specially designed for a number of reasons. In particular, the mooring system must not interfere with one or more subsea oil risers that are employed to transfer oil from the offshore production facility to the FPSO. Additionally, the mooring system must be designed to withstand adverse environmental conditions, including rough seas and strong winds, since offshore production facilities are typically located in areas subject to such conditions.

The foregoing requirements have resulted in the design of a number of different mooring arrangements for FPSOs. The most popular design is known as a single point turret mooring system in which only the bow (or stern) of the FPSO is attached to the mooring by means of a vessel mounted rotatable turret, thus allowing the FPSO to pivot or "weathervane" about a single axis of rotation in response to wind or water currents. Previous turret mooring systems have consisted of a number of mooring lines that are attached to the rotatable turret. The turret mooring is typically attached to the seabed by 5 to 20 mooring lines arranged in a radial or clustered pattern.

Due to the forces imparted on the lines by the vessel, the lines must be made to withstand high maximum loads, thus increasing their cost. In addition, these arrangements may require that a drive system be provided on the vessel for rotating the turret as the vessel weathervanes. This is necessary because frictional forces in the turret prevent the forces imparted by the mooring lines from turning the turret on their own. As a result, the mooring lines will get twisted and tangled if the drive system is not provided.

SUMMARY OF THE INVENTION

The present invention addresses the foregoing concerns through provision of a mooring system that employs a vessel mounted turret structure in combination with a submerged chain table that also acts as a clump weight. The chain table is submerged close to the sea surface at approximately the keel depth of the vessel or a few meters below that depth, the selected depth being approximately 25 meters or less. Three or more chains connect the vessel mounted turret and chain table to one another, preferably with groups of corresponding U-joints. A first group of the U-joints is attached to a top side of the chain table. Each of these U-joints is spaced around the top side of the chain table adjacent its periphery. Similarly, a second group of the U-joints is attached to the bottom side of the turret mooring adjacent its periphery. Opposite ends of each anchor chain are attached to corresponding ones of the U-joints, one on the chain table, and the other on the turret. Several mooring lines are attached at first ends to the bottom of the chain table, and are secured at second ends to anchors or piles in the seabed.

The foregoing arrangement is advantageous for a number of reasons. First, the weight of the chain table helps reduce the stresses imparted by the vessel to the mooring lines, thereby reducing the maximum load requirement and thus cost of the mooring lines. In addition, the arrangement eliminates the need for a vessel mounted drive system for the turret mooring. This is because the anchor chains connecting the chain table to the turret mooring are of such a length, and are positioned and spaced in such a manner, that the chain table will apply sufficient restraining forces to the turret through the chains and U-joints, that the vessel will rotate relative to the turret in response to wind and wave currents. As a result, it is not necessary that a separate drive system be provided to rotate the turret when the vessel weathervanes about the mooring.

BRIEF DESCRIPTION OF THE DRAWINGS

The features and advantages of the invention will become apparent from the following detailed description of a preferred embodiment thereof, taken in conjunction with the accompanying drawings, in which.

DETAILED DESCRIPTION OF A PREFERRED EMBODIMENT

Figure 1:
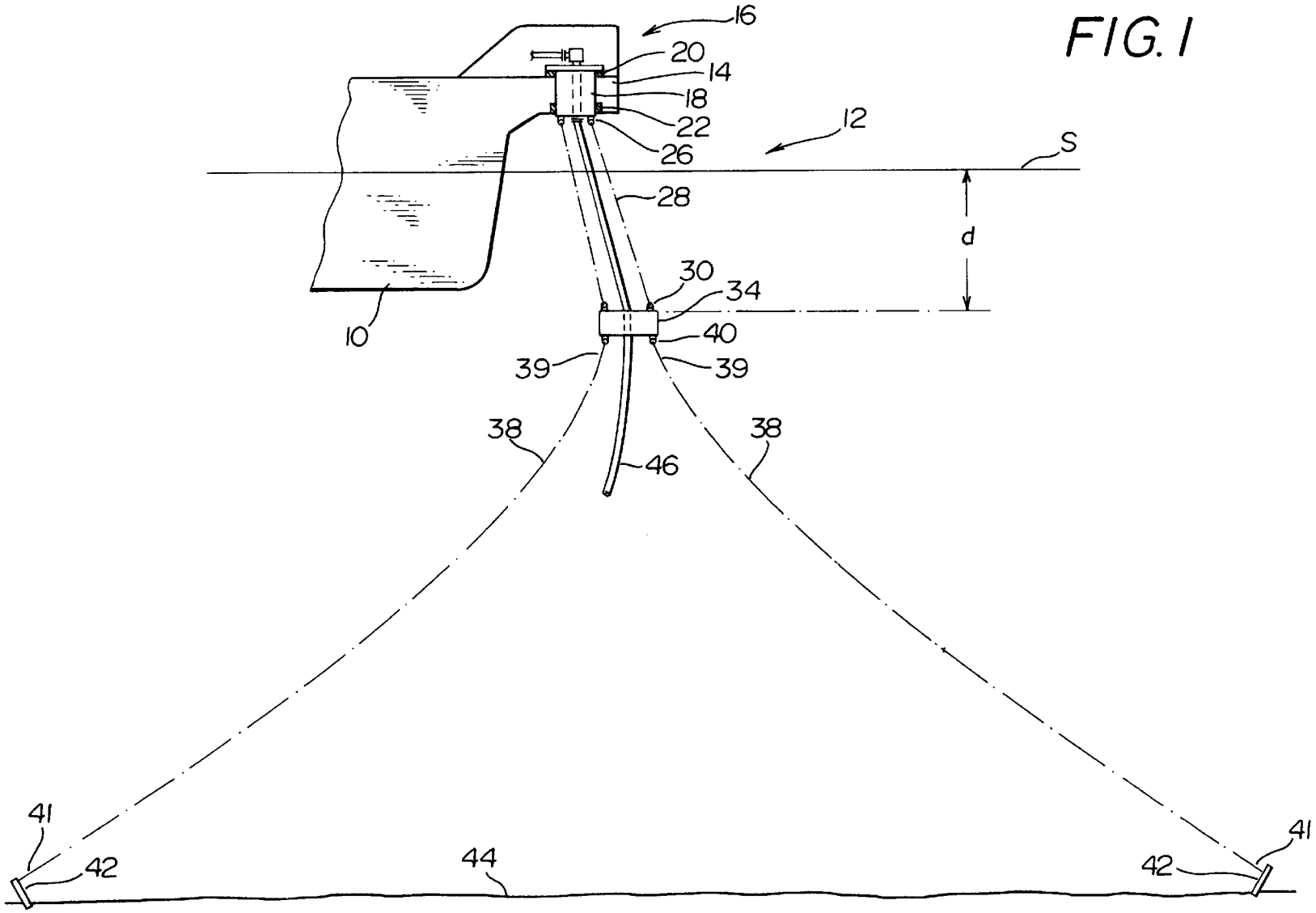
FIG. 1 is a diagrammatic illustration of a mooring system constructed in accordance with the preferred embodiment of the present invention.

With reference to FIG. 1, an FPSO vessel 10 is shown moored in position by a mooring system 12 that is constructed in accordance with a preferred embodiment of the present invention. The vessel 10 includes an extension 14 located at its bow 16 that houses a rotatable turret structure 18. To facilitate this rotation, the turret 18 is mounted by means of a pair of bearings 20 and 22, the top 20 of which is a thrust and radial bearing, and the bottom 22 of which is a radial bearing.

Figure 2:
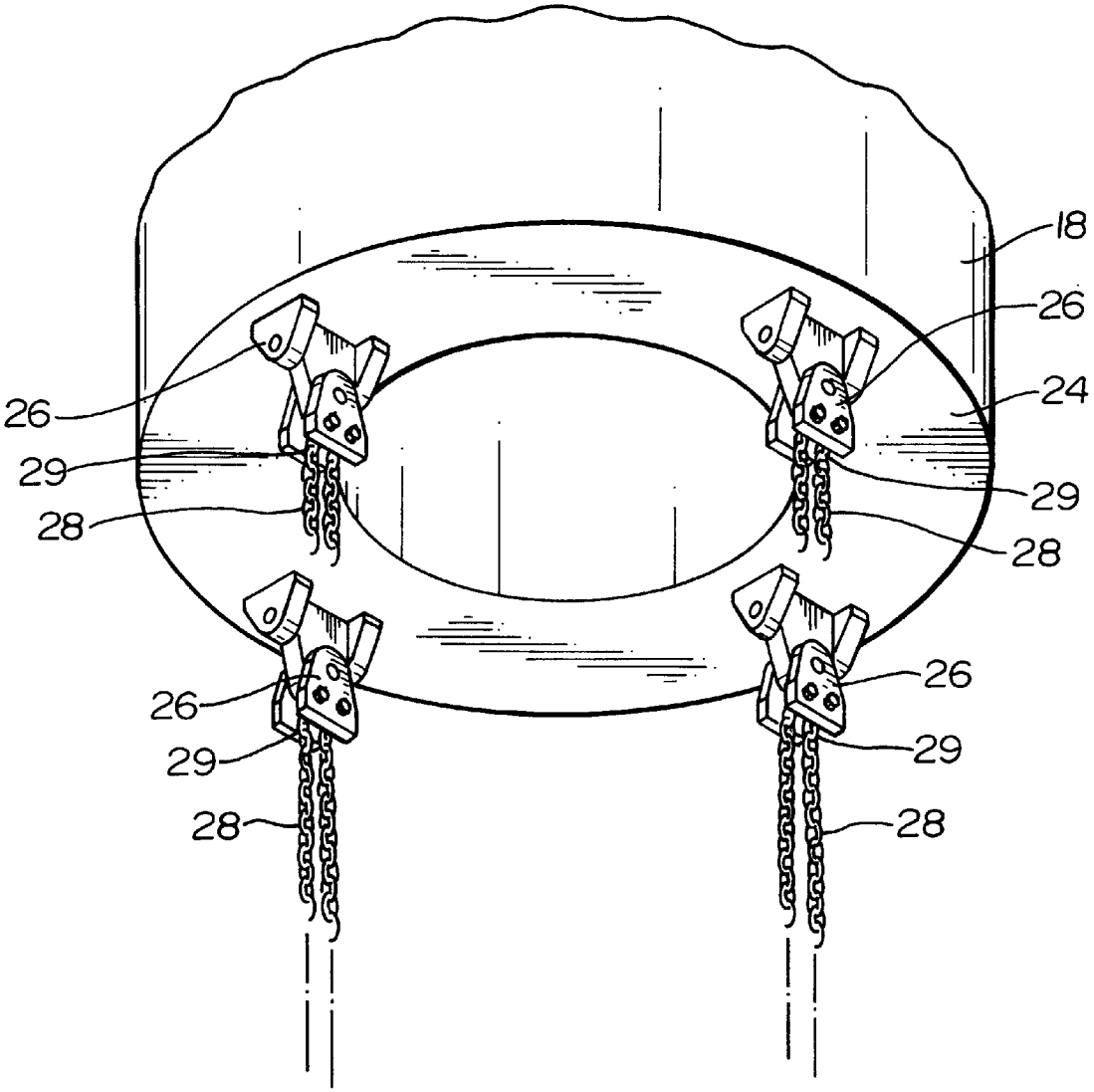
FIG. 2 is a perspective view of the bottom side of a vessel mounted turret employed in the mooring system of FIG. 1.
Figure 3:
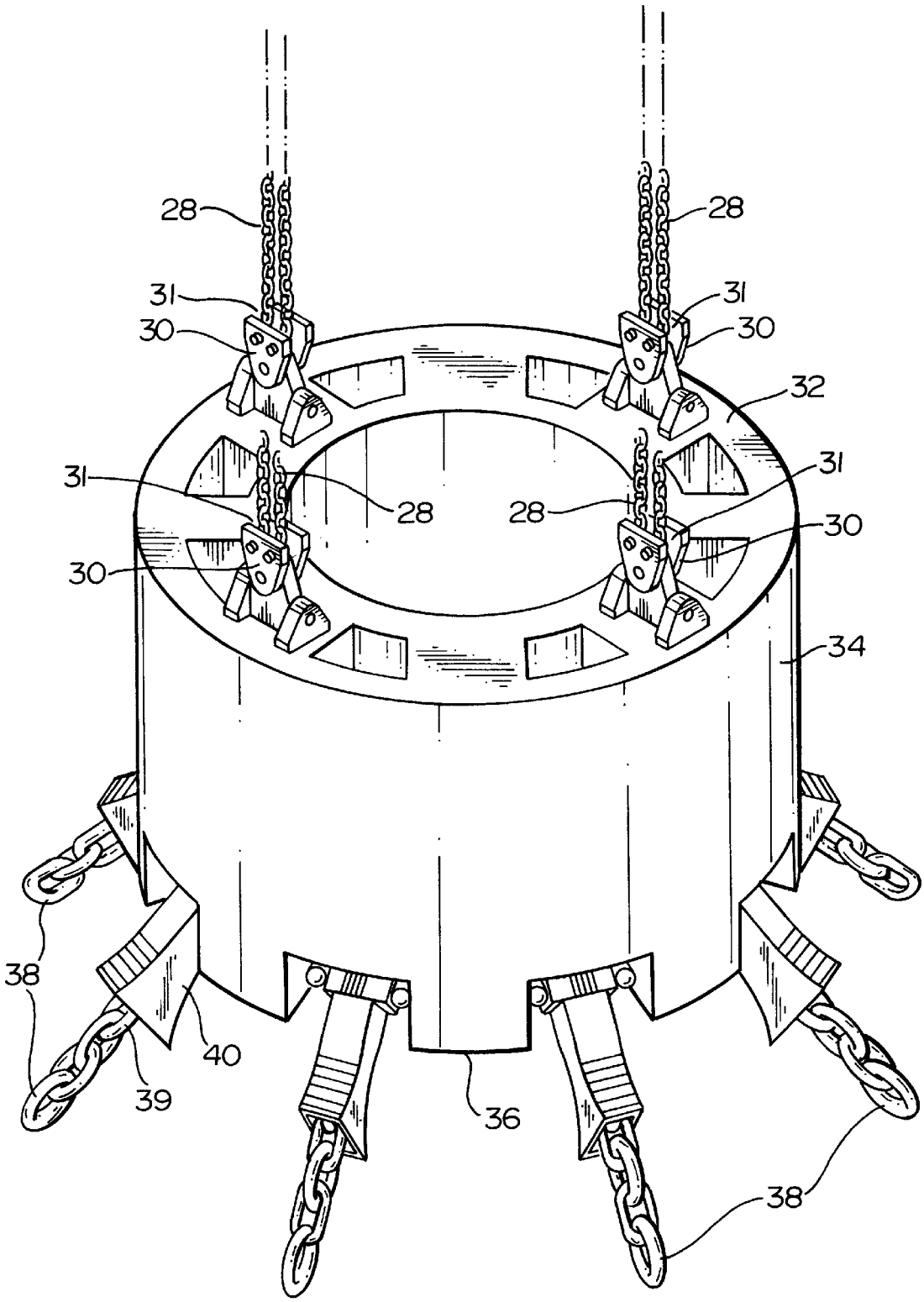
FIG. 3 is a perspective view of the chain table employed in the mooring system of FIG. 1.

Mounted to a bottom side 24 of the turret 18, as illustrated in FIG. 2, are four turret U-joints 26 which facilitate swivel connections to four corresponding pairs of anchor chains 28. The turret U-joints 26 are equally spaced adjacent the periphery of the bottom side 24 of the turret 18 on a circle of approximately 3 to 4 meters in diameter, and are connected to corresponding first ends 29 of the anchor chains 28. As illustrated in FIG. 3, four chain table U-joints 30, which are connected to corresponding second ends 31 of the pairs of anchor chains 28, are mounted on a top side 32 of a chain table 34. Again, the chain table U-joints 30 are equally spaced adjacent the periphery of the top side 32 of the chain table 34 on a circle of approximately 3 to 4 meters in diameter. The anchor chains 28 are each preferably rated to: withstand up to about 3.5 million lbs., and are preferably 5.5 inch diameter R3S chains. It should be noted that although four each of the anchor chain pairs 28, turret U-joints 26 and chain table U-joints 30 are employed in the preferred embodiment, the system will work with three or more of each of these elements. Less than three is not suitable because the system 12 could not safely endure a single chain failure.

Depending from a bottom side 36 of the chain table 34 are a number of mooring lines 38, each of which is attached at a top end 39 to the chain table 34 by means of a corresponding chain stopper connection 40. As illustrated in FIG. 1, the mooring lines 38 fan out in a catenary fashion, and are each connected at a bottom end 41 to a corresponding anchor or piling 42 secured to the seabed 44.

One or more flexible risers 46 extend from a fluid swivel 48 on the FPSO 10 down through apertures in the turret 18 and chain table 34 to the seabed 44, and to a subsea wellhead or offshore platform (not shown). The risers 46 are used for well effluent and injection of gas and water.

A key feature of the invention is that the chain table 34 acts as a weight, and is preferably submerged to a depth d below the water surface s of no greater than approximately 25 meters, the actual depth being preferably the keel depth of the FPSO 10, or a few meters below that point. The preferred weight of the chain table 34 is between 100,000 and 1.2 million lbs.

The advantage of this arrangement is that the weighted chain table 34 insulates the mooring lines 38 from the forces imparted by the FPSO 10 as it moves and rotates in response to environmental forces. Consequently, each of the mooring lines 38 can have a reduced maximum load rating and cost as compared to conventional single point mooring system lines. More particularly, the mooring lines 38 can be selected to be substantially less rugged than mooring lines in conventional single point mooring systems that typically are 6 inches in diameter, and are rated to withstand more than 4.5 million lbs. Preferably, between 8 and 12 of the mooring lines 38 are employed, each of which preferably is no more than 5 inches in diameter (e.g., type R3 chain), and is rated to sustain no more than 3 million lbs. Although the anchor chains 28 do have to be rugged enough to endure the vessel forces, these chains are much shorter in length, on the order of 30 to 35 meters.

Another advantage of this arrangement is that the spaced positioning of the anchor chains 28 on a circle of approximately 3–4 meters in diameter, and their short relative length, insures that the chains 28 will transmit enough restraining force to the turret 18 as the FPSO rotates relative to the chain table 34, that the turret 18 will rotate relative to the FPSO 10 without additional assistance. This eliminates the need for a separate drive system on the FPSO 10 to rotate the turret 18.

Thus, in the operation of the mooring system 12, as the weather forces move the FPSO 10 back, the tension begins to rise in the forward facing ones of the mooring lines 38. This increase in tension applies a side force to the chain table 34 that tends to move the table 34 forward and off center as illustrated in FIG. 1. The side force is transmitted via the anchor chains 28 and U-joints 26 and 30 to the turret 18 and hence the FPSO 10, thus tending to restrain the FPSO 10. The effect of the weighted chain table 34 is to reduce the maximum load applied to the mooring lines 38 by the FPSO 10.

Although the present invention has been disclosed in terms of a preferred embodiment, it will be understood that numerous modifications and variations could be made thereto without departing from the scope of the invention as defined in the following claims.

What is claimed is:

1. A mooring system for a vessel comprising:

a) a rotatable turret attached to a vessel to be moored;

b) a chain table submerged to a depth of no greater than 25 meters below a water surface;

c) a group of at least three anchor chains for securing said chain table to said turret; and d) a plurality of catenary mooring lines each having a lower end secured to a sea bed and an upper end connected to a bottom side of said chain table.

2. The mooring system of claim 1, wherein each of said anchor chains has a top end and a bottom end, and said system further comprises:

e) a first group of three or more U-joints for connecting said anchor chains to a bottom side of said turret, each of said U-joints being connected to a top end of a corresponding one of said anchor chains, and to said bottom side of said turret, said U-joints being spaced from one another, and positioned adjacent a periphery of said bottom side of said turret; and i) a second group of three or more U-joints for connecting said anchor chains to a top side of said chain table, each of said U-joints in said second group being connected to the bottom end of a corresponding one of said anchor chains, and to said top side of said chain table, said U-joints being spaced from one another, and positioned adjacent a periphery of said op side of chain table.

3. The mooring system of claim 2, wherein four each of said anchor chains and said U-joints in said first and second groups are provided in said system, said U-joints be equally spaced from one another along a circle between 3 and 4 meters in diameter.

4. The mooring system of claim 1, wherein said chain table has a weight of at least 100,000 lbs.

5. The mooring system of claim 1, wherein each of said mooring lines is no greater than 5 inches in diameter, and has a maximum load rating no greater than 3 million lbs.

6. The mooring system of claim 5, wherein no more than 12 of said mooring lines are provided in said system.

7. The mooring system of claim 5, wherein each of said anchor chains is no longer than 35 meters, has a diameter of at least 5.5 inches, and has a maximum load rating of at least 3.5 million lbs.

8. A mooring system for a vessel comprising:

a) a rotatable turret mooring attached to a vessel to be moored;

b) a submerged chain table, said chain table having a weight of at least 100,000 lbs.;

c) a group of at least three anchor chains for securing said chain table to said turret mooring, each of said chains having a top end and a bottom end, and being no longer than 35 meters in length d) a first group of three or more U-joints for connecting said anchor chains to a bottom side of said turret mooring, each of said U-joints being connected to a top end of a corresponding one of said anchor chains, and to said bottom side of said turret mooring, said U-joints being spaced from one another, and positioned adjacent a periphery of said turret mooring;

e) a second group of three or more U-joints for connecting said anchor chains to a top side of said chain table, each of said U-joints in said second group being connected to the bottom end of a corresponding one of said anchor chains, and to said top side of said chain table, said U-joints being spaced from one another, and positioned adjacent a periphery of said chain table; and f) a group of no more than 12 catenary mooring lines each having a lower end secured to a sea bed and an upper end connected to a bottom side of said chain table, each of said mooring lines being no greater than 5 inches in diameter, and having a maximum load rating of no greater than 3 million lbs.

9. The mooring system of claim 8, wherein four each of said anchor chains and said U-joints in said first and second groups are provided in said system, said U-joints be equally spaced from one another along a circle between 3 and 4 meters in diameter.

10. The mooring system of claim 8, wherein each of said anchor chains has a diameter of at least 5.5 inches, and has a maximum load rating of at least 3.5 million lbs.

11. A method for mooring a fluid carrying vessel comprising the steps of:

a) providing a rotatable turret attached to a vessel to be moored;

b) providing a chain table submerged to a depth of no greater than 25 meters;

c) connecting said turret to said chain table with a group of at least three anchor chains; and d) securing a plurality of catenary mooring lines at a lower end to a seabed and at an upper end to a bottom side of said chain table.

12. The method of claim 11, further comprising the steps:

e) providing a first group of three or more U-joints for connecting said anchor chains to a bottom side of said turret, each of said U-joints being connected to a top end of a corresponding one of said anchor chains, and to said bottom side of said turret, said U-joints being spaced from one another, and positioned adjacent a periphery of said bottom side of said turret; and f) providing a second group of three or more U-joints for connecting said anchor chains to a top side of said chain table, each of said U-joints in said second group being connected to a bottom end of a corresponding one of said anchor chains, and to said top side of said chain table, said U-joints being spaced from one another, and positioned adjacent a periphery of said top side of chain table.

13. The method of claim 12, wherein four each of said anchor chains and said U-joints in said first and second groups are provided in said system, said U-joints be equally spaced from one another along a circle between 3 and 4 meters in diameter.

14. The method of claim 11, wherein said chain table is selected to have a weight of at least 100,000 lbs.

15. The method of claim 11, wherein each of said mooring lines is selected to be no greater than 5 inches in diameter, and have a maximum load rating no greater than 3 million lbs.

16. The method of claim 15, wherein no more than 12 of said mooring lines are provided.

17. The method of claim 11, wherein each of said anchor chains is selected to have a diameter of at least 5.5 inches, and have a maximum load rating of at least 3.5 million lbs.

18. The method of claim 11, wherein said chain table is selected to have a weight of at least 100,000 lbs.; each of said mooring lines is selected to be no greater than 5 inches in diameter, and have a maximum load rating no greater than 3 million lbs.; and, each of said anchor chains is selected to have a diameter of at least 5.5 inches, and have a maximum load rating of at least 3.5 million lbs.

* * * * *